US009338870B2

(12) United States Patent
Tao et al.

(10) Patent No.: US 9,338,870 B2
(45) Date of Patent: May 10, 2016

(54) EXTREME ULTRAVIOLET LIGHT SOURCE

(71) Applicant: ASML Netherlands B.V., Veldhoven (NL)

(72) Inventors: Yezheng Tao, San Diego, CA (US); John Tom Stewart, IV, San Diego, CA (US); Daniel J.W. Brown, San Diego, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 14/563,496

(22) Filed: Dec. 8, 2014

(65) Prior Publication Data

US 2015/0189728 A1 Jul. 2, 2015

Related U.S. Application Data

(60) Provisional application No. 61/922,019, filed on Dec. 30, 2013.

(51) Int. Cl.
*H05G 2/00* (2006.01)
*G21K 5/00* (2006.01)

(52) U.S. Cl.
CPC ..... *H05G 2/008* (2013.01); *H05G 2/003* (2013.01)

(58) Field of Classification Search
CPC ..... H05G 2/00; H05G 2/001; H05G 2/003; H05G 2/005; H05G 2/006; H05G 2/008; G21K 5/00; G21K 5/02; G21K 5/08
USPC ..... 250/493.1, 494.1, 503.1, 504 R, 504 H
See application file for complete search history.

(56) References Cited

U.S. PATENT DOCUMENTS 6,973,164 B2 12/2005 Hartlove
7,239,686 B2 7/2007 Berglund (Continued)

FOREIGN PATENT DOCUMENTS

WO 2011/102277 A1 8/2011
WO 2011/122397 A1 10/2011
WO WO 2013174620 A1 * 11/2013 ..... H05G 2/006

OTHER PUBLICATIONS

Larsen. Jon T., "Absorption and Profile Modification on Spherical Targets for .25 < λ< 2 microns," Presentation at the 8th Annual Conference on Anomalous Absorption of Electromagnetic Waves, Apr. 19-21, 1978, 48 pages.

(Continued)

*Primary Examiner* — Michael Logie
*Assistant Examiner* — David E Smith
(74) *Attorney, Agent, or Firm* — DiBerardino McGovern IP Group LLC

(57) ABSTRACT

A first remaining plasma that at least partially coincides with a target region is formed; a target including target material in a first spatial distribution to the target region is provided, the target material including material that emits EUV light when converted to plasma; the first remaining plasma and the initial target interact, the interaction rearranging the target material from the first spatial distribution to a shaped target distribution to form a shaped target in the target region, the shaped target including the target material arranged in the shaped spatial distribution; an amplified light beam is directed toward the target region to convert at least some of the target material in the shaped target to a plasma that emits EUV light; and a second remaining plasma is formed in the target region.

23 Claims, 10 Drawing Sheets

(56) References Cited

U.S. PATENT DOCUMENTS

| | | | | |
|---|---|---|---|---|
| 7,491,954 | B2 | 2/2009 | Bykanov | |
| 7,608,846 | B2 | 10/2009 | Nakano | |
| 7,916,388 | B2 | 3/2011 | Bykanov | |
| 7,923,705 | B2 | 4/2011 | Moriya | |
| 7,999,241 | B2 | 8/2011 | Nagai | |
| 8,242,472 | B2 | 8/2012 | Moriya | |
| 8,324,600 | B2 | 12/2012 | Hayashi | |
| 8,791,440 | B1 * | 7/2014 | Tao | H01S 3/10 250/493.1 |
| 8,872,143 | B2 | 10/2014 | Rafac | |
| 2006/0255298 | A1 | 11/2006 | Bykonov | |
| 2010/0051831 | A1 | 3/2010 | Tao | |
| 2010/0090133 | A1 * | 4/2010 | Endo | G03F 7/70033 250/504 R |
| 2010/0181503 | A1 | 7/2010 | Yanagida | |
| 2011/0057126 | A1 | 3/2011 | Hoshino | |
| 2011/0317256 | A1 | 12/2011 | Hou | |
| 2012/0092746 | A1 | 4/2012 | Hou | |
| 2012/0228525 | A1 | 9/2012 | Moriya | |
| 2012/0228526 | A1 * | 9/2012 | Vaschenko | 250/504 R |
| 2012/0235066 | A1 | 9/2012 | Ershov | |
| 2012/0243566 | A1 * | 9/2012 | Hori et al. | 372/27 |
| 2012/0248344 | A1 | 10/2012 | Wakabayashi et al. | |
| 2012/0305811 | A1 * | 12/2012 | Wakabayashi | H05G 2/008 250/504 R |
| 2012/0307851 | A1 | 12/2012 | Hori | |
| 2012/0313016 | A1 | 12/2012 | Fleurov | |
| 2012/0319014 | A1 | 12/2012 | Moriya | |
| 2013/0146682 | A1 | 6/2013 | Ishihara | |
| 2014/0183379 | A1 | 7/2014 | Hori | |

OTHER PUBLICATIONS

Garban-Labaune et al., "Resonance Absorption in CO2 Laser-Plane Targets Interaction Experiments," Journal De Physique-Lettres, vol. 41, No. 19, Oct. 1980, pp. 463-467.

Nakano et al., "Sn Droplet Target Development for Laser Produced Plasma EUV Light Source," Proc. SPIE, Emerging Lithographic Technologies XII, vol. 6921, 2008, 8 pages.

Fujimoto et al.,"Developnrient of Laser-Produced Tin Plasma-Based EUV Light Source Technology for HVM EUV Lithography," Physics Research International, vol. 2012, Article ID 249495, Jun. 2012, pp. 1-11.

Ueno et al., "Enhancement of Extreme Ultraviolet Emission from a CO2 Laser-Produced Sn Plasma Using a Cavity Target", Applied Physics Letters 91, 2007, pp. 231501-1 to 231501-3.

Tao et al.,"Interaction of a CO2 Laser Pulse with Tin-Based Plasma for an Extreme Ultraviolet Lithography Source," IEEE Transactions on Plasma Science, vol. 38, No. 4, Apr. 2010, pp. 714-718.

International Search Report of the International Searching Authority for counterpart International Application No. PCT/EP2014/078500, mailed May 20, 2015, 4 pages.

Written Opinion of the International Searching Authority for counterpart International Application No. PCT/EP2014/078500, mailed May 20, 2015, 4 pages.

* cited by examiner

EXTREME ULTRAVIOLET LIGHT SOURCE

CROSS-REFERENCE TO RELATED APPLICATION

This application claims the benefit of U.S. Provisional Application No. 61/922,019, filed on Dec. 30, 2013 and titled EXTREME ULTRAVIOLET LIGHT SOURCE, which is incorporated herein by reference in its entirety.

TECHNICAL FIELD

The disclosed subject matter relates to a target for a laser produced plasma extreme ultraviolet light source.

BACKGROUND

Extreme ultraviolet (EUV) light, for example, electromagnetic radiation having wavelengths of around 50 nm or less (also sometimes referred to as soft x-rays), and including light at a wavelength of about 13 nm, can be used in photolithography processes to produce extremely small features in substrates, for example, silicon wafers.

Methods to produce EUV light include, but are not necessarily limited to, converting a material that has an element, for example, xenon, lithium, or tin, with an emission line in the EUV range in a plasma state. In one such method, often termed laser produced plasma (LPP), the required plasma can be produced by irradiating a target material, for example, in the form of a droplet, plate, tape, stream, or cluster of material, with an amplified light beam that can be referred to as a drive laser. For this process, the plasma is typically produced in a sealed vessel, for example, a vacuum chamber, and monitored using various types of metrology equipment.

SUMMARY

In one general aspect, a method of forming a shaped target for an extreme ultraviolet light source includes forming a first remaining plasma that at least partially coincides with a target region; providing a target including target material in a first spatial distribution to the target region, the target material including material that emits EUV light when converted to plasma; allowing the first remaining plasma and the initial target to interact, the interaction rearranging the target material from the first spatial distribution to a shaped target distribution to form a shaped target in the target region, the shaped target including the target material arranged in the shaped spatial distribution; directing an amplified light beam toward the target region to convert at least some of the target material in the shaped target to a plasma that emits EUV light, the amplified light beam having an energy sufficient to convert the target material in the shaped target to plasma that emits EUV light; and allowing a second remaining plasma to form in the target region.

Implementations can include one or more of the following features. The shaped target distribution can include sides that extend from a vertex, the sides defining a recess that is open to the amplified light beam.

The shaped target distribution can include a concave region that is open to the amplified light beam.

The amplified light beam can be a pulsed amplified light beam.

Providing a target material in a first spatial distribution to the target region can include providing a disk-shaped target to the target region. Providing a disk-shape target can include releasing a target material droplet including target material from a target material supply apparatus toward the target region; directing a pulse of radiation toward the target material droplet to interact the pulse of radiation with the target material droplet while the target material droplet is between the target material supply apparatus and the target region, the first pulse of radiation having an energy sufficient to initiate a modification of a spatial distribution of the target material of the target material droplet; and allowing the target material droplet to expand in two dimensions after the interaction between the pulse of radiation and the target material droplet to form the disk-shaped target. The target material droplet can expand in two dimensions by expanding in a plane that is perpendicular to a direction of propagation of the amplified light beam. The target material droplet can narrow in a direction that is parallel to the direction of propagation to form the disk-shaped spatial distribution of target material. The first pulse of radiation can be a pulse of laser light having a wavelength of 1.06 microns (μm) and the amplified light beam can be a pulsed laser beam having a wavelength of 10.6 μm. The first pulse of radiation and the amplified light beam can have the same wavelength.

In some implementations, a second target that includes target material in the first spatial distribution to the target region can be provided. The second remaining plasma and the second target can interact, the interaction arranging the target material in the first spatial distribution to the shaped target distribution to form a second shaped target in the target region, the amplified light beam can be directed toward the target region to convert at least some of the second shaped target to a plasma that emits EUV light, and a third remaining plasma can form in the target region.

In some implementations, the amplified light beam is directed toward the target region and the second shaped target no more than 25 microseconds (μs) after the amplified light beam is directed toward the first shaped target. A first burst of EUV light can be produced after directing the amplified light bean toward the target region and the shaped target, and a second burst of EUV light can produced after directing the amplified light bean toward the target region and the second shaped target, the first and second EUV bursts occurring no more than 25 μs apart.

In another general aspect, a method includes forming a first remaining plasma that at least partially coincides with a target region, the remaining plasma being a plasma formed from a previous EUV-light producing interaction between target material and an amplified light beam; providing a target including target material in a first spatial distribution to the target region, the target material including material that emits EUV light when converted to plasma; initiating a modification of the first spatial distribution of target material in two dimensions by interacting the target with a first pulse of radiation; allowing the first spatial distribution of target material to change in the two dimensions after interacting the target with the first pulse of radiation to form a modified target; shaping the modified target in three dimensions by allowing the modified target to enter into the target region and interact with the first remaining plasma to form a shaped target; and directing an amplified light beam toward the target region and the shaped target to form a plasma that emits extreme ultraviolet (EUV) light.

Implementations can include one or more of the following features. The two dimensions can be two dimensions that extend in a plane that is perpendicular to the direction of propagation of the amplified light beam. Initiating a modification of the first spatial distribution in two dimensions can include directing a pulsed laser beam toward the target such that a pulse of the laser beam interacts with the target. The two dimensions can include two dimensions that extend in a plane that is perpendicular to the direction of propagation of the pulsed laser beam.

The modified target can have a larger cross-sectional area in the plane that is perpendicular to the direction of propagation of the pulsed laser beam than the target. The shaped target distribution can include a concave region that is open to the amplified light beam. The target region can be located in an interior of a vacuum chamber of an EUV light source.

Implementations of any of the techniques described above may include a target for a laser produced plasma EUV light source, an EUV light source, a method of producing EUV light, a system for retrofitting an EUV light source, a method, a process, a device, executable instructions stored on a computer readable medium, or an apparatus. The details of one or more implementations are set forth in the accompanying drawings and the description below. Other features will be apparent from the description and drawings, and from the claims.

DRAWING DESCRIPTION

DESCRIPTION

Figure 1:
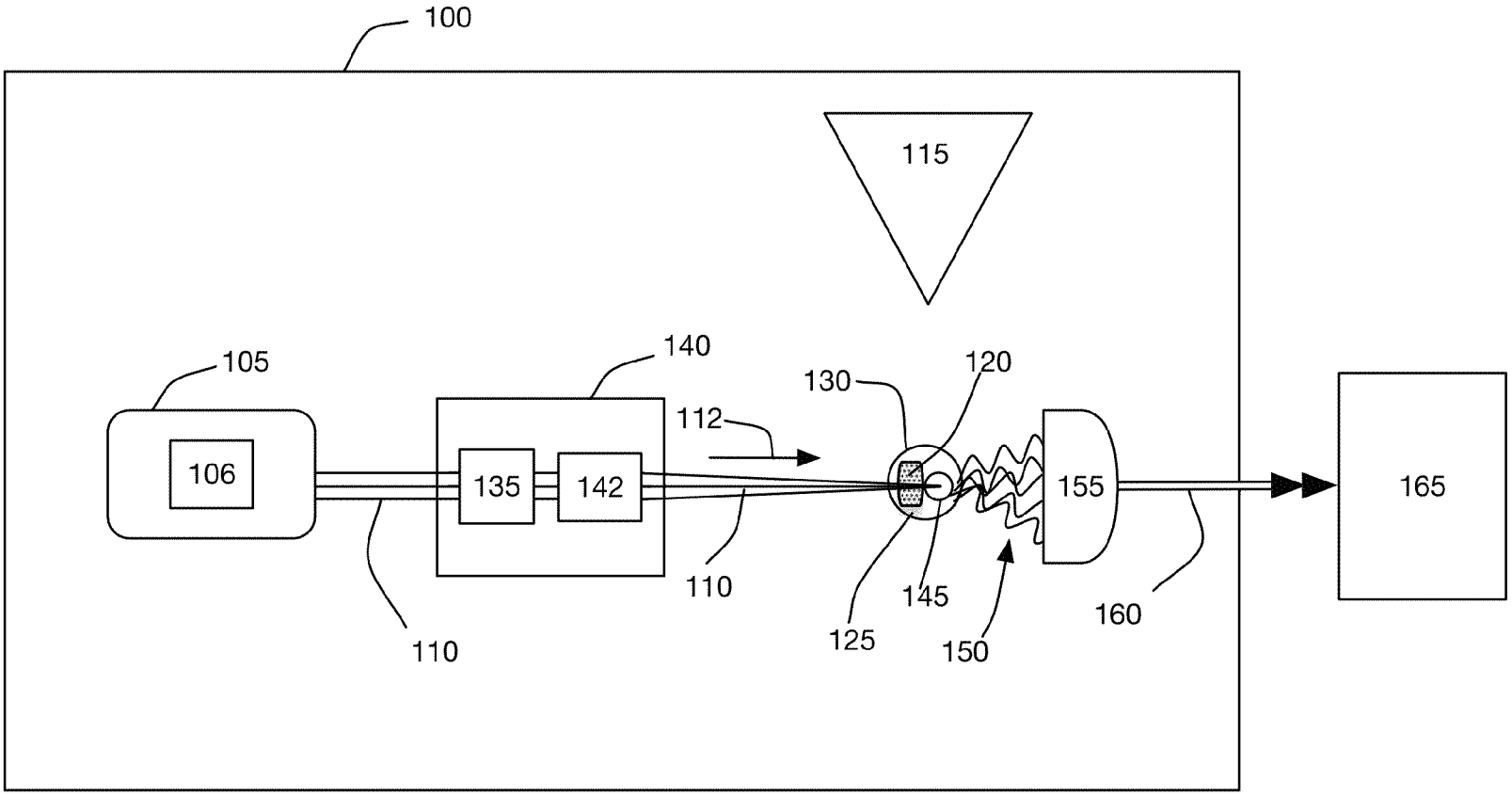
FIG. 1 is a block diagram of an exemplary laser produced plasma extreme ultraviolet light (EUV) source.

Techniques for producing a shaped target are disclosed. The target can be used in an extreme ultraviolet (EUV) light source. The shaped target includes target material that emits EUV light when converted to plasma. The target material can be converted to plasma that emits EUV light by, for example, irradiating the target material with an amplified light beam. The shaped target is formed in real-time by exposing an initial target, which includes target material, to a "remaining plasma."

The remaining plasma is matter that remains in a region after the target material is converted to the plasma that emits EUV light in the region. The remaining plasma can be any matter that is present in the region due to an earlier interaction between target material and light that resulted in generation of a plasma that emits EUV light. The remaining plasma is the remains or remnants of the plasma that emits EUV light and can include debris generated from the interaction between the amplified light beam and the target material. The remaining plasma can include, for example, hot gas, atoms, ions, microparticles (which can be, for example, particles having a diameter of 1-1000 μm, such as dust), particles, and/or rarified gas. The remaining plasma is not necessarily a plasma, but can include plasma. The density and temperature of the remaining plasma can be spatially and/or temporally varying. Thus, the region that includes the remaining plasma can be considered a region of nonhomogeneous density and temperature. It is possible that when target material enters this nonhomogeneous region, asymmetric forces act on the target material to change the spatial distribution (shape) of the target material. In some instances, the spatial distribution of the target material can be changed from a disk-like shape into a V-like shape that has sides that meet at an apex and a recess that is open to an oncoming amplified light beam.

The material that makes up the shaped target has a spatial distribution (or shape), and the shape can result from an interaction between the initial target and the remaining plasma. The shaped target can provide greater confinement of plasma and a larger EUV emitting volume, leading to increased EUV light production. Additionally, the shaped target is formed in the EUV light source (for example, inside of a vacuum chamber of the EUV light source) while the EUV light source is operating. Consequently, the shaped target can be used in a high repetition rate, for example, 40 kilohertz (kHz), 100 kHz, or greater, EUV light source.

In some implementations, the shaped target is a concave target with a recessed portion or cavity that is open to an oncoming amplified light beam that has energy sufficient to convert at least part of the shaped target to plasma. The cavity is open to the oncoming amplified light beam by being oriented in a manner that allows at least a portion of the cavity to receive and interact with the amplified light beam. For example, the shaped target can be a "V" shaped target, with a recessed or valley portion of the "V" open to the oncoming amplified light beam. The sides of the "V" envelopes the plasma and confines the plasma that is generated through the interaction of the target with the amplified light beam in the recessed portion. In this way, the plasma that is formed has a longer scale length than would be achieved by forming a plasma from an interaction between the amplified light beam and a flat target that lacks a recess. The scale length of a plasma defines the light absorption region and is given by the local density divided by the density gradient. A longer scale length indicates that the plasma more readily absorbs light, and, therefore, emits more EUV light. Additionally, the shape of the target provides a larger EUV emitting volume, which also increases the amount of EUV light emitted from the target.

Referring to FIG. 1, an optical amplifier system 106 forms at least part of an optical source 105 (also referred to as a drive source or a drive laser) that is used to drive a laser produced plasma (LPP) extreme ultraviolet (EUV) light source 100. The optical amplifier system 106 includes at least one optical amplifier such that the optical source 105 produces an amplified light beam 110 that is provided to a target region 130. The target region 130 receives a target material 120, such as tin, from a target material delivery system 115, and an interaction between the amplified light beam 110 and the target material 120 (or a shaped target produced through an interaction between remaining plasma in the target region 130 and target material) produces plasma 125 that emits EUV light or radiation 150 (only some of the EUV radiation 150 is shown in FIG. 1 but it is possible for the EUV radiation 150 to be emitted in all directions from the plasma 125). A light collector 155 collects at least some of the EUV radiation 150, and directs the collected EUV light 160 toward an optical apparatus 165 such as a lithography tool.

The amplified light beam 110 is directed toward the target region 130 by a beam delivery system 140. The beam delivery system 140 can include optical components 135 and a focus assembly 142, which focuses the amplified light beam 110 in the focal region 145. The components 135 can include optical elements, such as lenses and/or mirrors, which direct the amplified light beam 110 by refraction and/or reflection. The components 135 also can include elements that control and/or move the components 135. For example, the components 135 can include actuators that are controllable to cause optical elements of the beam delivery system 140 to move.

The focus assembly 142 focuses the amplified light beam 110 so that the diameter of the beam 110 is at a minimum in the focal region 145. In other words, the focus assembly 142 causes the radiation in the amplified light beam 110 to converge as it propagates toward the focal region 145 in a direction 112. In the absence of a target, the radiation in the amplified light beam 110 diverges as the beam 110 propagates away from the focal region 145 in the direction 112.

FIGS. 2A-2D show target material interacting with a light beam 210 and a remaining plasma in a target region 230. The target region 230 can be a target region in an EUV light source, such as the target region 130 of the light source 100 (FIG. 1). The interaction between the target material and the remaining plasma changes the spatial distribution of the target material, shaping the target material into a shaped target.

In the example of FIGS. 2A-2D, the amplified light beam 210 is pulsed. The pulsed amplified light beam includes pulses of light or radiation that occur at regular intervals, with each pulse having a temporal duration. The temporal duration of a single pulse of light or radiation can be defined as the amount of time during which the pulse has an intensity that is greater than or equal to a percentage (for example 50%) of the maximum intensity of the pulse. For a percentage of 50%, this duration can also be referred to as the full width at half maximum (FWHM).

The interaction between a pulse of the amplified light beam 210 and the target material converts at least part of the target material into plasma, generating a remaining plasma that lingers or remains in the target region 230 after the interaction between the pulse and the target material ends. As discussed below, the remaining plasma is used to shaped target material that subsequently enters the target region 230.

Figure 2A:
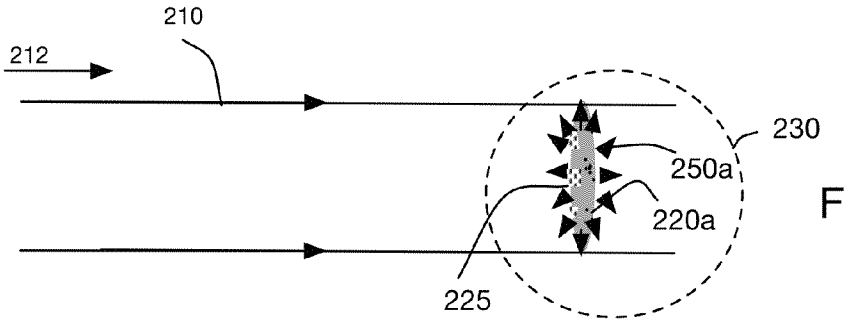
FIG. 2A is a side cross-sectional view of an exemplary target in a target region.

Referring to FIG. 2A, a side view of an exemplary target material 220*a* interacting with a pulse 211*a* (FIG. 2C) of the amplified light beam 210 at a target region 230 is shown. Irradiation by the pulse 211*a* converts at least a portion of the target material 220*a* to plasma 225 that emits EUV light 250*a*.

Figure 2B:
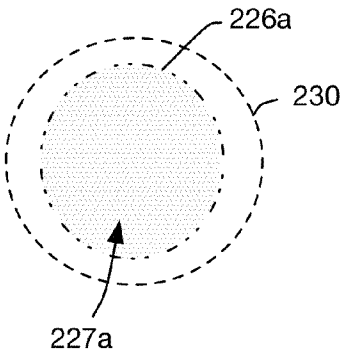
FIG. 2B is a side cross-sectional view of a remaining plasma in the target region of FIG. 2A.

Referring also to FIG. 2B, the target region 230 after the pulse 211*a* of the amplified light beam 210 has irradiated and consumed the target material 220*a* is shown. After the pulse 211*a* converts the target material 220*a* to plasma, a region of remaining plasma 226*a* is formed in the target region 230. FIG. 2B shows a cross-section of the region of remaining plasma 226*a* and the remaining plasma 227*a*, both of which occupy a three-dimensional region.

The remaining plasma 227*a* in the region of remaining plasma 226*a* can include all, a portion, or none of the plasma 225, and also can include hot gases, debris, such as portions of the target material 220*a* and/or pieces or particles of target material that were not converted to the plasma 225. The remaining plasma 227*a* can have a density that varies in the region 226*a*. For example, the density can have a gradient that increases inward from the outer portion of the region 226*a*, with the highest density being at or near the center of the region 226*a*.

Figure 2C:
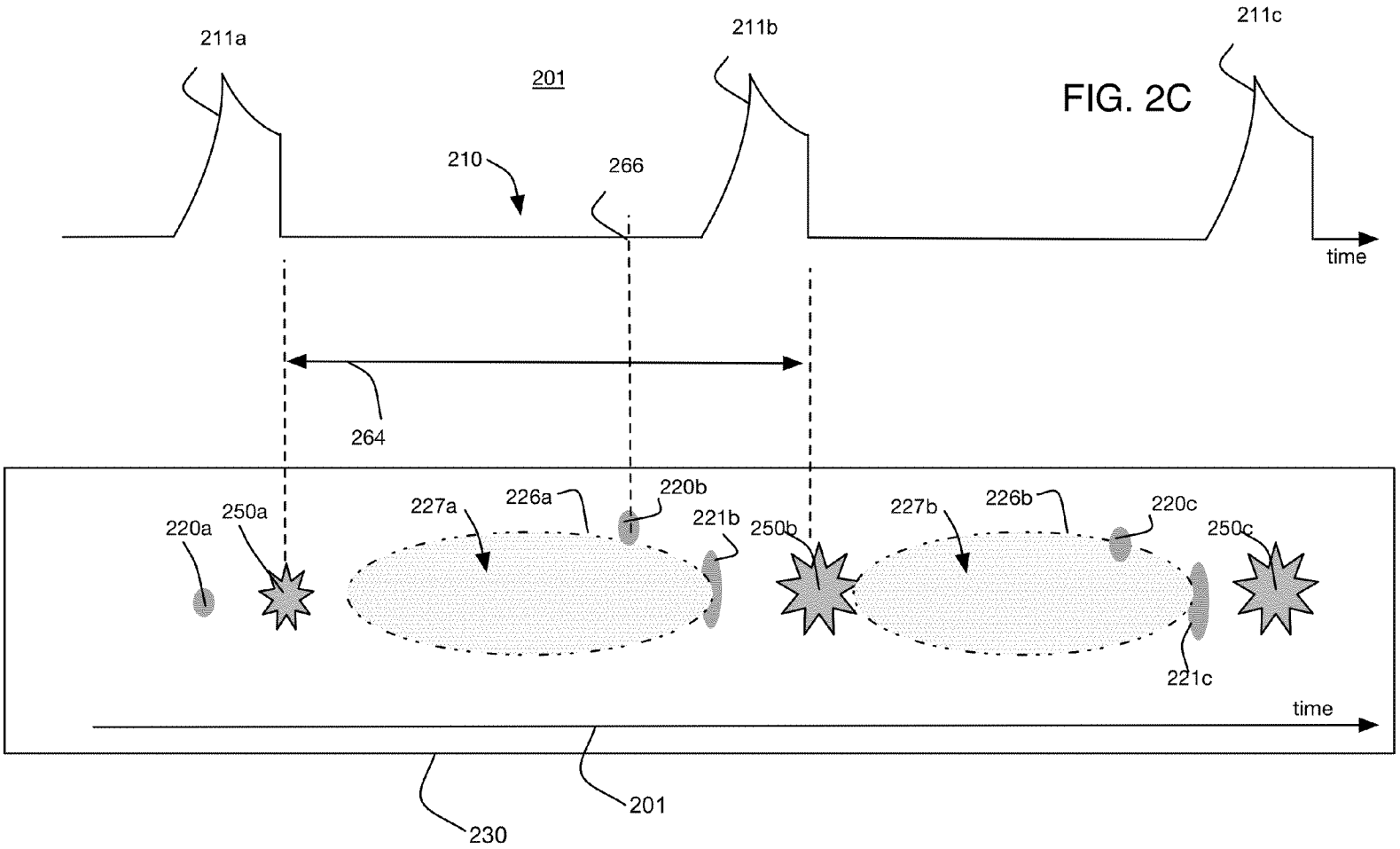
FIG. 2C is a plot of an exemplary waveform, shown as energy versus time, acting on the target region of FIG. 2A over time.

FIG. 2C shows a plot of the intensity of the amplified light beam 210 that arrives at the target region 230 over a time period 201. Three cycles of the amplified light beam 210, each including a respective pulse of radiation 211*a*-211*c*, are shown. The lower part of FIG. 2C shows a cross section of the target region 230 over the time period 201. The pulse 211*a*-211*c* of the amplified light beam 210, respectively, is applied to each of targets 220*a*-220*c* to produce respective EUV light emissions 250*a*-250*c*.

The target materials 220*a*-220*c* are in the target region 230 at three different times. The target material 220*a* is in the target region 230 when the first pulse 211*a* arrives in the target region 230. The pulse 211*a* is the first pulse in the amplified light beam 210, and, thus, there is no remaining plasma in the target region 230 when the target material 220*a* arrives in the target region 230.

The target material 220*b* arrives at the target region 230 at a time 266 that occurs after the region of plasma 226*a* has been formed. At the time 266, the target material 220*b* and the remaining plasma 227*a* are both in the target region 230 and begin to interact with each other. The interaction between the remaining plasma 227*a* and the target material 220*b* shapes the target material 220*b* into a shaped target 221*b*, which more readily absorbs the amplified light beam 210 than the target material 220*b*. For example, the conversion efficiency associated with converting the shaped target 221*b* to plasma can be 30% more than the conversion efficiency associated with converting the target material 220*a* to plasma.

After the target material 220*b* is shaped, or while the target material 220*b* is being shaped, by the remaining plasma 227*a*, the pulse 211*b* of the amplified light beam 210 interacts with the shaped target 221*b*. Due to this interaction, at least a portion of the target material in the shaped target 221*b* is converted to a plasma that emits EUV light. Additionally, a region of remaining plasma 226*b* with remaining plasma 227*b* is generated. In this manner, a new instance of the remaining plasma is generated after each interaction between a pulse and the target material. This new instance of the remaining plasma also lingers in the target region 230 and is available to shape subsequent target material that enters the target region 230.

At a time after the time 266 and while the remaining plasma 227*b* is in the target region 230, a target material 220*c* arrives in the target region 230. An interaction between the remaining plasma 227*b* and the target material 220*c* produces a shaped target 221*c*, and an interaction between the pulse 211*c* and the shaped target 221*c* produces an EUV emission 250*c*.

The density gradient of and/or space occupied by the regions of plasma and remaining plasma can vary over time. For example, the remaining plasma 227*a* and 227*b* in the regions 226*a* and 226*b*, respectively, can dissipate to occupy a larger volume of space and the density gradient of the remaining plasma 227*a* and 277*b* can become less steep as the time since the most recent interaction between the amplified light beam 210 and a target increases.

The EUV light emissions 250*a* and 250*b* are separated by a time duration 264 that is the inverse of the repetition rate of the EUV light source. The EUV light source's system repetition rate can be, for example, 40 kHz-100 kHz. Thus, the time duration 264 can be twenty-five (25) microseconds (μm) or less. The time between the EUV light emissions 250*a* and 250*b* depends on the temporal separation of the pulses in the amplified light beam 210, thus, the repetition rate of the source that generates the amplified light beam 210 at least partially determines the repetition rate of the overall EUV light source.

The speed at which the shaped targets 221*b* and 221*c* are generated depends on the repetition rate of the source that produces the amplified light beam 210 and the rate at which initial target material is provided. For example, a shaped target can be generated after every interaction between a pulse of the amplified light beam 210 and a target material that results in the production plasma. Thus, the shaped targets can be generated at, for example, 40 kHz-100 kHz. In this manner, shaped targets can be generated in real-time and while the EUV light source is operating. Further, the relatively high repetition rate (for example, 40 kHz-100 kHz) allows the initial target material to enter the target region 230 while the remaining plasma is present.

Moreover, because the formation of the shaped target takes advantage of the remaining plasma that is present from the previous laser-target material interaction that resulted in the production of a plasma that emits EUV light, the repetition rate of an EUV source that uses the shaped target is not limited by the time to form the shaped target and the EUV source can have a repetition rate that is the same as the rate of production of the shaped targets.

Figure 3:
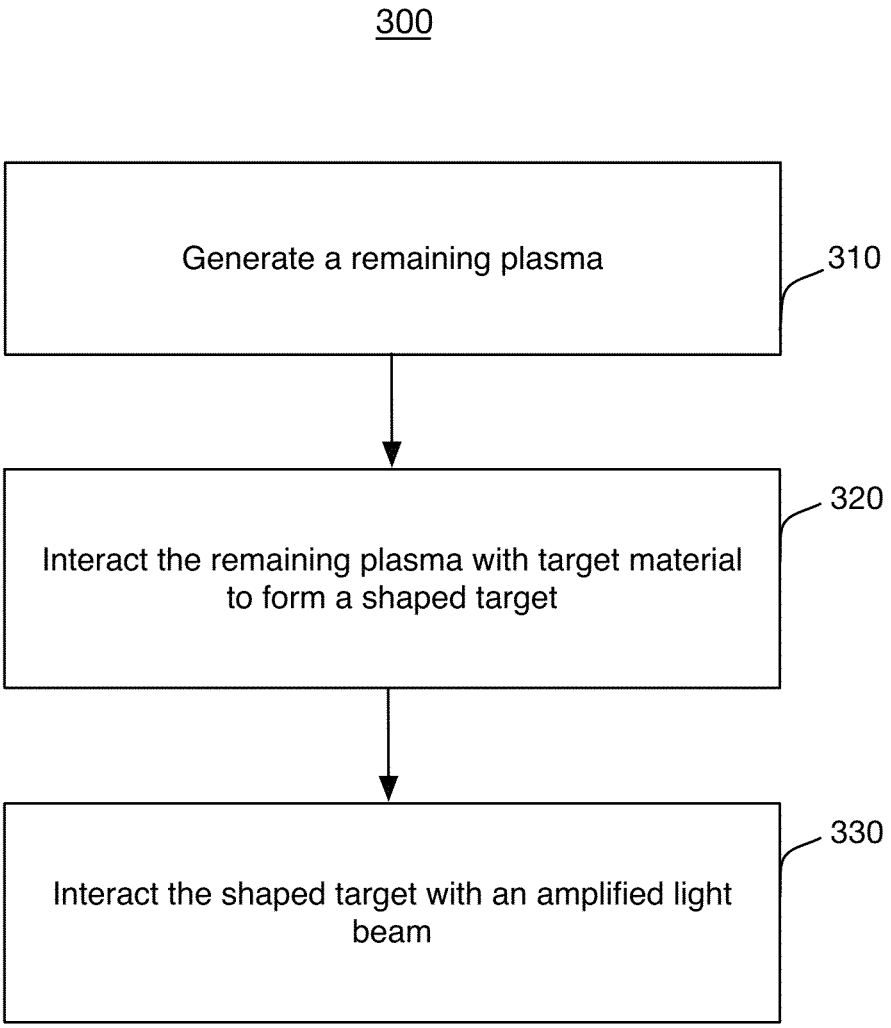
FIGS. 3 and 4 are flow charts of exemplary processes for generating a shaped target.

Referring to FIG. 3, a flow chart of an exemplary process 300 for forming a shaped target is shown. The process 300 can be performed in an EUV light source, such as the light source 100 of FIGS. 1 and 8 or the light source 602 of FIG. 6. The process 300 is discussed with respect to FIGS. 2A-2D.

The remaining plasma 227*a* is generated (310). For example, the remaining plasma 227*a* can be generated by interacting the amplified light beam 210 with the target material 220*a*. The interaction of the amplified light beam 210 and the target material 220*a* produces a plasma, which can emit EUV light. Remnants of the plasma that emits EUV light and associated debris lingers in the target region 230 after the EUV light emission, and this remaining plasma persists or otherwise occupies all or part of the target region 230 for a period of time after the target material 220*a* is converted into plasma. The remaining plasma 227*a* extends in three dimensions and occupies a volume. The remaining plasma 227*a* is in the target region 230 when the next target (the target material 220*b* in this example) arrives in the target region 230.

The target material 220*b* can be any material that includes target material that emits EUV light when converted to plasma. For example, the target material 220*b* can be tin. Additionally, the target material 220*b* can have any spatial form that produces an EUV-light emitting plasma when interacted with the amplified light beam 210. For example, the target material 220*b* can be a droplet of molten metal, a portion of a wire, a disk-shaped or cylinder-shaped segment of molten metal that has its widest extent oriented perpendicular to a direction of propagation of the amplified light beam 210. The example of the target material 220*b* having a disk or cylindrical shape is discussed with respect to FIGS. 5 and 6A-6C. In some implementations, the target material 220*b* can be a mist or a collection of particles or pieces of material separated by voids.

The target material 220*b* can be provided to the target region 230 by passing molten target material through a nozzle of a target material supply apparatus, such as the target material delivery system 115 of FIG. 1, and allowing the target material 220*b* to drift into the target region 230. In some implementations, the target material 220*b* can be directed to the target region 230 by force.

The shape of the target material 220*b* can be modified before reaching the target region 230 by, for example, irradiating the target material 220*b* with a pre-pulse (a pulse of radiation that interacts with the target material before an interaction with a pulse of the amplified light beam 210) as the target material 220*b* drifts toward the target region 230. An example of such an implementation is discussed with respect to FIGS. 4 and 5A-5C. Additionally or alternatively, in some implementations, the shape of the target material 220*b* changes as it drifts toward the target region 230 due to aerodynamic forces.

The remaining plasma 227*a* interacts with the target material 220*b* to form the shaped target 221*b* (320). When the target material 220*b* meets the remaining plasma 227*a*, the density of the remaining plasma 227*a* bends or otherwise spatially deforms the target material 220*b* to form the shaped target 221*b*. For example, the density of the remaining plasma 227 can be higher than the surrounding region, and the physical impact of encountering the plasma 227*a* can bend a portion of the target material 220*b* into a "V" shape or a concave target with a recess open to the amplified light beam 210. The recess is an open region between sides that include target material. The sides intersect at an apex, with the apex being farther from the amplified light beam than the recess. The sides can be generally curved and/or angled relative to each other to form and define the recess.

As the target material 220*b* drifts further into the remaining plasma 227*a*, the remaining plasma 227*a* continues to bend or deform the target material 220*b* into a shaped target. The remaining plasma 227*a* can have a density gradient (or spatially varying density) within the plasma region 226*a*. For example, the density can have a gradient that increases inward from the outer portion (circumference) of the region 226*a*, with the highest density being at or near the center of the region 226*a*.

The amplified light beam 210 and the shaped target 221*b* interact (330). The interaction between the amplified light beam 210 and the shaped target 221*b* can be caused or initiated by, for example, directing the pulse 211*b* of the amplified light beam 210 toward the target region 230 so that the light in the pulse 211*b* irradiates the shaped target 221*b*. The interaction between the pulse 211*b* and the shaped target 221*b* generates the EUV light 250*b* and the remaining plasma 227*b*.

FIGS. 4 and 5A-5C show examples of forming a shaped target with a pre-pulse and remaining plasma. The process 300 can be performed in an EUV light source, such as the light source 100 of FIGS. 1 and 8 or the light source 602 of FIG. 6.

Figure 4:
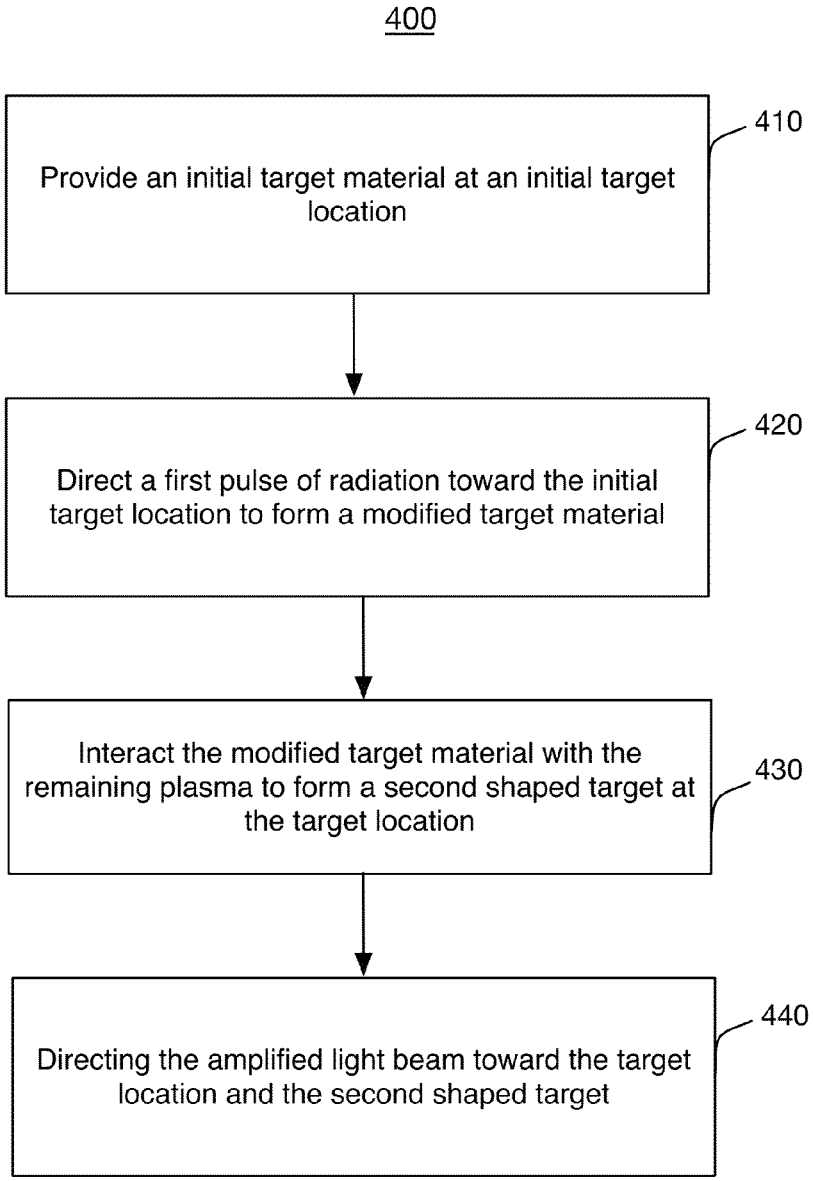
Figure 5A:
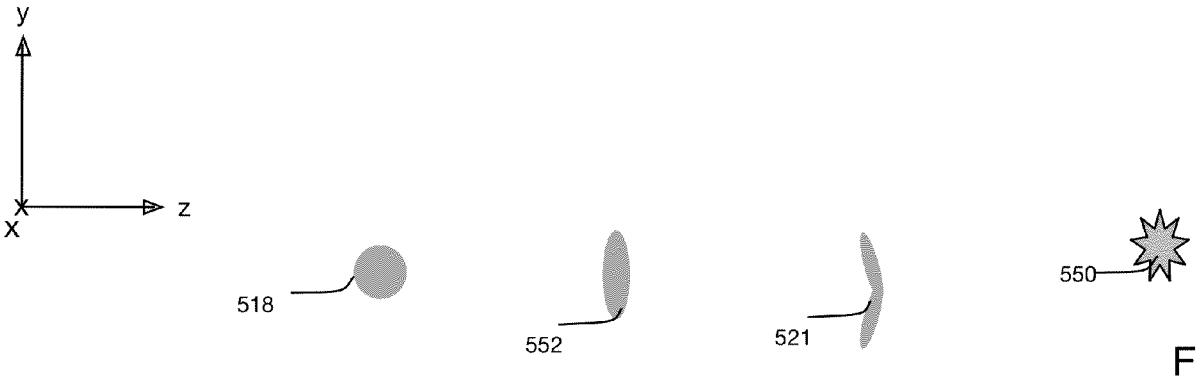
FIG. 5A shows an exemplary initial target that is converted to a shaped target.
Figure 5B:
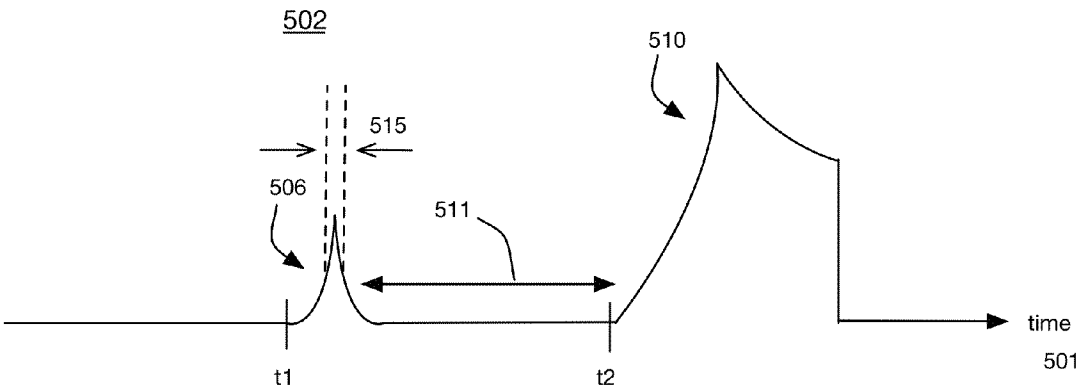
FIG. 5B is a plot of an exemplary waveform, shown as energy versus time, for generating the shaped target of FIG. 5A.
Figure 5C:
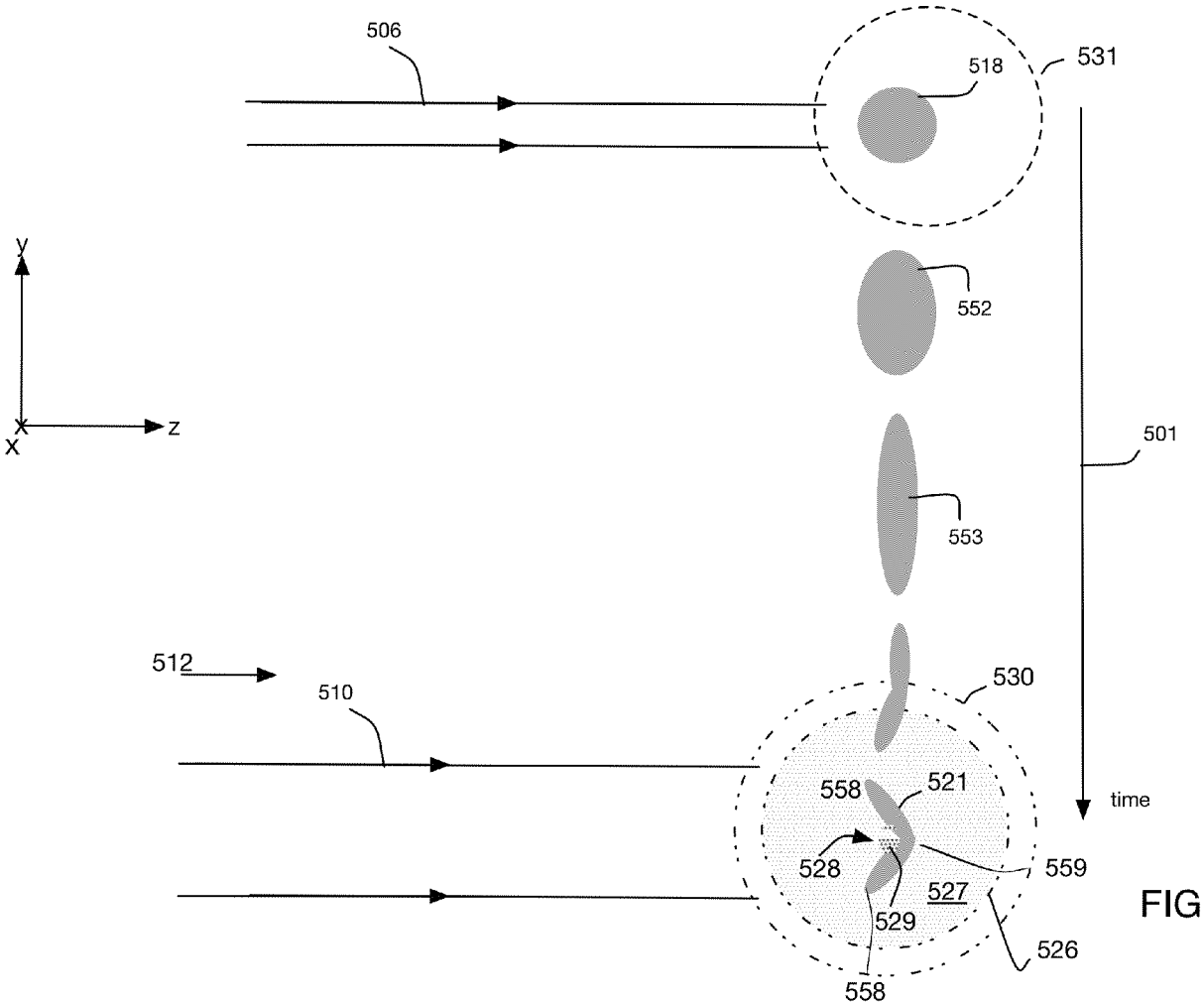
FIG. 5C shows side views of the initial target and the target of FIG. 5A.

Referring to FIG. 4, a flow chart of an exemplary process 400 for generating a shaped target is shown. Referring also to FIGS. 5A-5C, an example of the process 400 is shown.

An exemplary waveform 502 (FIG. 5B) and a remaining plasma 527 (FIG. 5C) transform an initial target material 518 into a shaped target 521. The remaining plasma 527 is present in a target region 530 and includes matter that was generated by a prior interaction between an amplified light beam and target material. The initial target material 518 and the target 521 include target material that emits EUV light 550 when converted to plasma through irradiation with an amplified light beam 510.

In greater detail and referring to FIG. 4, the initial target material 518 is provided at an initial target region 531 (410). In this example, the initial target material 518 is a droplet of molten metal, such as tin. The droplet can have a diameter of, for example, 30-60 μm or 33 μm. The initial target material 518 can be provided to the initial target region 531 by releasing target material from a target material supply apparatus (such as the target material delivery system 115 of FIG. 1) and directing the initial target material 518 to or allowing the initial target material 518 to drift into the initial target region 531.

The target material can be a target mixture that includes a target substance and impurities such as non-target particles. The target substance is the substance that is converted to a plasma state that has an emission line in the EUV range. The target substance can be, for example, a droplet of liquid or molten metal, a portion of a liquid stream, solid particles or clusters, solid particles contained within liquid droplets, a foam of target material, or solid particles contained within a portion of a liquid stream. The target substance can be, for example, water, tin, lithium, xenon, or any material that, when converted to a plasma state, has an emission line in the EUV range. For example, the target substance can be the element tin, which can be used as pure tin (Sn); as a tin compound, for example, $SnBr_4$, $SnBr_2$, $SnH_4$; as a tin alloy, for example, tin-gallium alloys, tin-indium alloys, tin-indium-gallium alloys, or any combination of these alloys. Moreover, in the situation in which there are no impurities, the target material includes only the target substance. The discussion below provides an example in which the initial target material 518 is a droplet made of molten metal. However, the initial target material 518 can take other forms.

A first pulse of radiation 506 is directed toward the initial target region 531 (420). The interaction between the first pulse of radiation 506 and the initial target material 518 forms a modified target material 552. As compared to the initial target material 518, the modified target material 552 has a side cross section with an extent that is greater in the y direction, and is less in the z direction.

FIGS. 5A and 5C show a time period 501 during which the initial target material 518 physically transforms into the modified target material 552, to the shaped target 521, and then emits EUV light 550. FIG. 5B is a plot of the energy in the waveform 502 of the amplified light beam 510 as a function of time over the time period 501. The waveform 502 includes a representation of a pulse of radiation 506 (a pre-pulse 506) and a pulse of an amplified light beam 510. The pre-pulse 506 can also be referred to as a conditioning pulse.

The pre-pulse 506 can be any type of pulsed radiation that has sufficient energy to act on the initial target material 518, for example, to change the shape of the initial target material 518 or initiate a change in the shape of the initial target material 518. The pre-pulse 506 is incident on a surface of the initial target material 518 and the interaction between the pre-pulse 506 and the initial target material 518 can produce a cloud of debris, gasses, and/or plasma (that does not necessarily emit EUV light) at the surface of the target material. Although EUV light can be emitted from a plasma generated by the interaction of the pre-pulse 506 and the initial target material 518, any EUV light emitted would be much less than, for example, an interaction between target material and the amplified light beam 510.

The force of the impact of the first pre-pulse 506 deforms the initial target material 518 into a modified target material 552 that has a shape that is different than the shape of the initial target material 518. For example, the initial target material 518 can have a shape that is similar to a droplet, while the shape of the modified target material 552 can be closer to a disk. The modified target material 552 can be a material that is not ionized (a material that is not a plasma). The modified target material 552 can be, for example, a disk of liquid or molten metal, a continuous segment of target material that does not have voids or substantial gaps, a mist of micro- or nano-particles, or a cloud of atomic vapor. In the example of FIG. 5C, the modified target material 552 expands, for example, after about 1-3 microseconds (μs), into a disk shaped piece of molten metal 553.

The pre-pulse has a duration 515. The pulse duration 515 of the pre-pulse 506 and the pulse duration of the main beam 510 can be represented by the full width at half maximum, that is, the amount of time that the pulse has an intensity that is at least half of the maximum intensity of the pulse. However, other metrics can be used to determine the pulse duration. The pulse duration 515 can be, for example, 30 nanoseconds (ns), 60 ns, 130 ns, 50-250 ns, 10-200 picoseconds (ps), or less than 1 ns. The energy of the pre-pulse 506 can be, for example, 1-70 milliJoules (mJ). The wavelength of the pre-pulse 506 can be, for example, 1.06 μm, 1-10.6 μm, 10.59 μm, or 10.26 μm.

In some implementations, the pre-pulse 506 can be focused to a focal plane by a focusing optic (such as the focus assembly 142 of FIG. 1). The focal plane includes the focus of the pre-pulse 506. The focus is the minimum spot size that the pre-pulse 506 forms in a plane that is perpendicular to the direction of propagation of the pre-pulse 506. The focus of a light beam occurs at the location, along the direction in which the beam propagates, where the beam has the smallest diameter in a plane that is perpendicular to the direction of propagation. The focus of the pre-pulse 506 can occur within the initial target region 531 or outside of the initial target region 531. The pre-pulse 506 can be focused onto the initial target material 518, and doing so may allow a delay time 511 between the pre-pulse 506 and the amplified light beam 510 to be reduced while still allowing the modified target 552 to expand spatially into the disk shape 553. In some implementations, the focus of the pre-pulse 506 can be 0.5 millimeters (mm)-1 mm away (on either side) from the initial target material 518, measured along the direction of propagation of the pre-pulse 506.

The amplified light beam 510 can be referred to as the main beam or the main pulse. The amplified light beam 510 has sufficient energy to convert target material in the target 521 to plasma that emits EUV light. The pre-pulse 506 and the amplified light beam 510 are separated in time by the delay time 511, with the amplified light beam 510 occurring at time $t_2$, which is after a time $t=t_1$ when the pre-pulse 506 occurs. The modified target material 552 expands during the delay time 511. The delay time 511 can be, for example, 1-3 microseconds (μs), 1.3 μs, 1-2.7 μs, or any amount of time that allows expansion of the modified target 552 into the disk shape 553.

Thus, in (420) of the process 500, the modified target 552 can undergo a two-dimensional expansion as the modified target 552 expands and elongates in the x-y plane. In (430) of the process 500, the target that has been allowed to undergo two-dimensional expansion (for example, the disk shape 553) can be shaped in three dimensions into a shaped target 521 through interaction with the remaining plasma 527.

Referring again to FIG. 4, the modified target 552 (or, if formed, the disk shape 553) is allowed to interact with the remaining plasma 527 to form the shaped target 521 at the target region 530 (430). The remaining plasma 527 is in the target region 530 when the modified target 552 reaches the target region 530.

When the disk shape 553 encounters the remaining plasma 527, the density of the remaining plasma 527 bends or otherwise spatially deforms the modified target (or the disk shape 553) to form the shaped target 521. The remaining plasma 527 can have a density gradient. For example, the density of the remaining plasma 527 can be higher than the surrounding region. In the example shown in FIG. 5C, the impact of encountering the plasma 527 bends a portion of the modified target material 552 (or the disk shape 553) into, for example, a "V" shape, a bowl-like shape, or a concave disk-like shape with a recess 528 that is open to the amplified light beam 510.

As the modified target material 552 (or disk shape 553) drifts further into the remaining plasma 227*a*, the remaining plasma 227*a* can continue to bend or deform the modified target material 552 (or disk shape 553) into the shaped target 521. The shaped target 521 is a three-dimensional shape with the recess 528 being an open region between wings or sides 558. The sides 558 are formed from the target material 552 (or the disk shape 553) folding about an apex 559, which is father from the amplified light beam 510 than the recess 528. Because the apex 559 is farther from the amplified light beam 510, the recess 528 is open to the amplified light beam 510. The sides 558 intersect at the apex 559, and the sides 558 extend outward from the apex 559. The shaped target 521 can have an approximately "V" shaped cross-section in a y-z plane that includes the apex 559. The cross-section can be approximately a "V" shape by, for example, having a curved apex 559 and/or one or more curved sides 558 and/or having the sides 558 extend from the apex 559 at different angles relative to the direction of propagation 512. The shaped target 521 can have other spatial forms. For example, the shaped target 521 can be shaped as a bowl (and thus has a semi-circular or semi-ellipsoidal shaped cross-section) in a y-z plane that includes the apex 559.

The amplified light beam 510 is directed toward the target region 530 (440). Directing the amplified light beam 510 toward the target region 530 can deliver a pulse of radiation to the target region 230 while the shaped target 521 is in the target region 230. Thus, directing the amplified light beam 510 toward the target region 230 can cause an interaction between the amplified light beam 510 and the shaped target 521. The interaction between the amplified light beam 510 and the target material in the target 521 produces plasma 529 that emits the EUV light 550.

The plasma 529 is confined to the recess 528 by the density of the sides 558 of the shaped target 521. The confinement allows further heating of the target 521 by the plasma 529 and/or the amplified light beam 510, leading to additional plasma and EUV light generation. As compared to the modified target material 552 or the disk shape 553, the shaped target 521 exposes a larger volume of target material to the amplified light beam 510. This increase in the volume of target material results in the shaped target 521 being able to absorb a higher portion of the energy in a pulse of radiation as compared to the portion that the modified target 552 or disk shape 553 can absorb. Thus, the shaped target 521 may lead to an increase in conversion efficiency (CE) and an increase in the amount of EUV light produced. Additionally, although the shaped target 521 exposes a larger volume of target material to the amplified light beam 510, the shaped target 521 is still dense enough to absorb the light in the amplified light beam 510 rather than simply breaking apart or otherwise allow the amplified light beam 510 to pass through without being substantially absorbed. The shaped target 521 also can have a larger EUV emitting volume that the modified target material 552.

The amplified light beam 510 can be a pulsed amplified light beam with a pulse duration of, for example, 130 ns, 200 ns, or 50-200 ns. Additionally, the amplified light beam 510 can be focused by a focusing optic (such as the focus assembly 142 of FIG. 1). The focus of the amplified light beam 510 can occur, for example, at the target 521, or 0.5 mm-2 mm on either side of the target 521 (measured in the direction 512, which is the direction of propagation of the amplified light beam 510).

Figure 6:
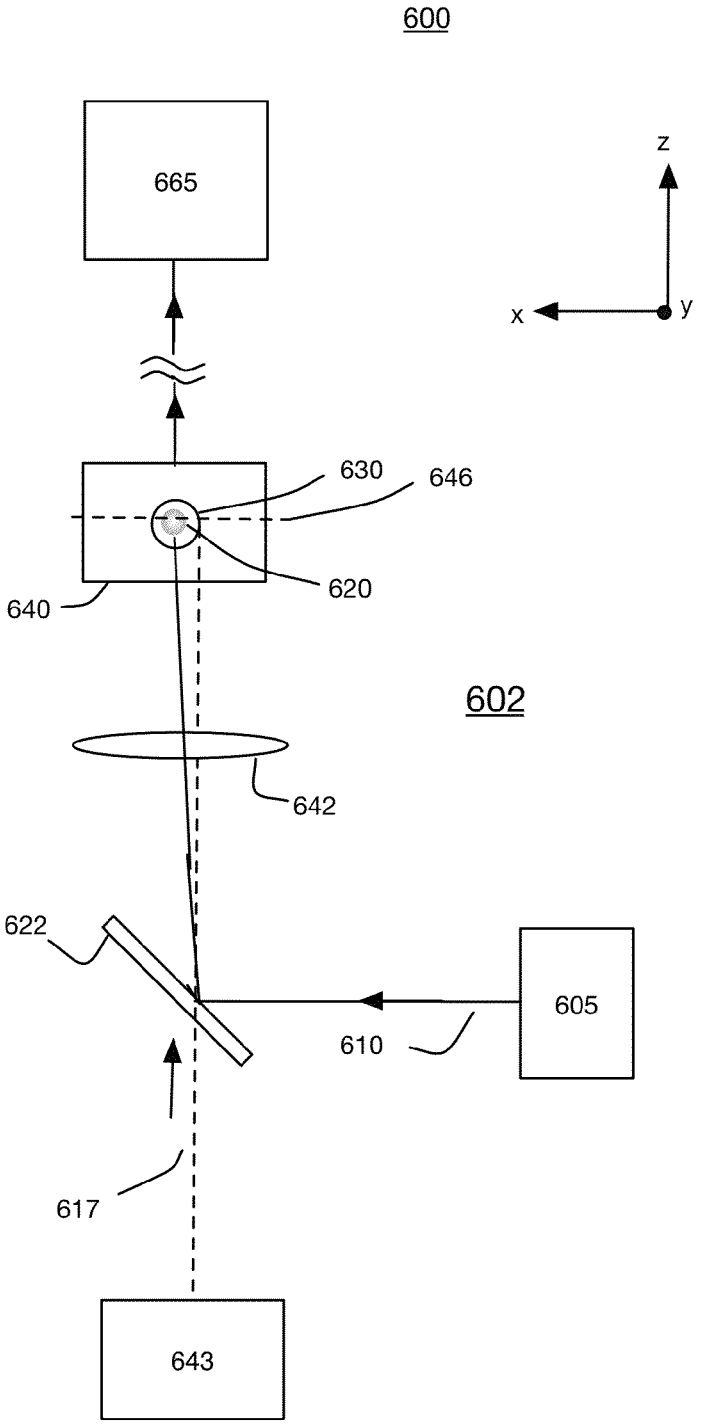
FIG. 6 is a block diagram of another laser produced plasma extreme ultraviolet (EUV) light source and a lithography tool coupled to the EUV light source.

Referring to FIG. 6, a block diagram of an exemplary optical imaging system 600 is shown. The system 600 can be used to perform the process 400 (FIG. 4). The optical imaging system 600 includes an LPP EUV light source 602 that provides EUV light to a lithography tool 665. The light source 602 can be similar to, and/or include some or all of the components of, the light source 100 of FIG. 1.

The system 600 includes an optical source such as a drive laser system 605, an optical element 622, a pre-pulse source 643, a focusing assembly 642, and a vacuum chamber 640. The drive laser system 605 produces an amplified light beam 610. The amplified light beam 610 has energy sufficient to convert target material in a target 620 into plasma that emits EUV light. Any of the targets discussed above can be used as the target 620.

The pre-pulse source 643 emits pulses of radiation 617 (in FIG. 6, the pulses of radiation 617 are shown with a dashed line to visually distinguish from the amplified light beam 610). The pulses of radiation can be used as the pre-pulse 506 (FIG. 5A-5C). The pre-pulse source 643 can be, for example, a Q-switched Nd:YAG laser that operates at a 50 kHz repetition rate, and the pulses of radiation 617 can be pulses from the Nd:YAG laser that have a wavelength of 1.06 μm. The repetition rate of the pre-pulse source 643 indicates how often the pre-pulse source 643 produces a pulse of radiation. For the example where the pre-pulse source 643 has a 50 kHz or higher repetition rate, a pulse of radiation 617 is emitted every 20 microseconds (μs).

Other sources can be used as the pre-pulse source 643. For example, the pre-pulse source 324 can be any rare-earth-doped solid state laser other that an Nd:YAG, such as an erbium-doped fiber (Er:glass) laser. In another example, the pre-pulse source can be a carbon dioxide laser that produces pulses having a wavelength of 10.6 μm. The pre-pulse source 643 can be any other radiation or light source that produces light pulses that have an energy and wavelength used for the pre-pulses discussed above.

The optical element 622 directs the amplified light beam 610 and the pulses of radiation 617 from the pre-pulse source 643 to the chamber 640. The optical element 622 is any element that can direct the amplified light beam 610 and the pulses of radiation 617 along similar or the same paths. In the example shown in FIG. 6, the optical element 622 is a dichroic beamsplitter that receives the amplified light beam 610 and reflects it toward the chamber 640. The optical element 622 receives the pulses of radiation 617 and transmits the pulses toward the chamber 640. The dichroic beamsplitter has a coating that reflects the wavelength(s)s of the amplified light beam 610 and transmits the wavelength(s) of the pulses of radiation 617. The dichroic beamsplitter can be made of, for example, diamond.

In other implementations, the optical element 622 is a mirror that defines an aperture (not shown). In this implementation, the amplified light beam 610 is reflected from the mirror surface and directed toward the chamber 640, and the pulses of radiation pass through the aperture and propagate toward the chamber 640.

In still other implementations, a wedge-shaped optic (for example, a prism) can be used to separate the main pulse 610 and the pre-pulse 617 into different angles, according to their wavelengths. The wedge-shaped optic can be used in addition to the optical element 622, or it can be used as the optical element 622. The wedge-shaped optic can be positioned just upstream (in the −z direction) of the focusing assembly 642.

Additionally, the pulses 617 can be delivered to the chamber 640 in other ways. For example, the pulses 617 can travel through optical fibers that deliver the pulses 617 to the chamber 640 and/or the focusing assembly 642 without the use of the optical element 622 or other directing elements. In these implementations, the fibers bring the pulses of radiation 617 directly to an interior of the chamber 640 through an opening formed in a wall of the chamber 640.

The amplified light beam 610 is reflected from the optical element 622 and propagates through the focusing assembly 642. The focusing assembly 642 focuses the amplified light beam 610 at a focal plane 646, which may or may not coincide with the target region 630. The pulses of radiation 617 pass through the optical element 622 and are directed through the focusing assembly 642 to the chamber 340. The amplified light beam 610 and the pulses of radiation 617, are directed to different locations along the "x" direction in the chamber 640 and arrive in the chamber 640 at different times.

In the example shown in FIG. 6, a single block represents the pre-pulse source 643. However, the pre-pulse source 643 can be a single light source or a plurality of light sources. For example, two separate sources can be used to generate a plurality of pre-pulses. The two separate sources can be different types of sources that produce pulses of radiation having different wavelengths and energies. For example, one of the pre-pulses can have a wavelength of 10.6 μm and be generated by a $CO_2$ laser, and the other pre-pulse can have a wavelength of 1.06 μm and be generated by a rare-earth-doped solid state laser.

In some implementations, the pre-pulses 617 and the amplified light beam 610 can be generated by the same source. For example, the pre-pulse of radiation 617 can be generated by the drive laser system 605. In this example, the drive laser system can include two $CO_2$ seed laser subsystems and one amplifier. One of the seed laser subsystems can produce an amplified light beam having a wavelength of 10.26 μm, and the other seed laser subsystem can produce an amplified light beam having a wavelength of 10.59 μm. These two wavelengths can come from different lines of the $CO_2$ laser. In other examples, other lines of the $CO_2$ laser can be used to generate the two amplified light beams. Both amplified light beams from the two seed laser subsystems are amplified in the same power amplifier chain and then angularly dispersed to reach different locations within the chamber 640. The amplified light beam with the wavelength of 10.26 μm can be used as the pre-pulse 617, and the amplified light beam with the wavelength of 10.59 μm can be used as the amplified light beam 610.

Some implementations can employ a plurality of pre-pulses before the main pulse. In these implementations, three or more seed lasers can be used. For example, in an implementation that employs two pre-pulses, one seed laser can be used to generate each of the amplified light beam 610, a first pre-pulse, and a second, separate pre-pulse. In other examples, the main pulse and one or more of the plurality of pre-pulses can be generated by the same source.

The amplified light beam 610 and the pre-pulse of radiation 617 can all be amplified in the same optical amplifier. For example, the three or more power amplifiers can be used to amplify the amplified light beam 610 and the pre-pulse 617.

Figure 7:
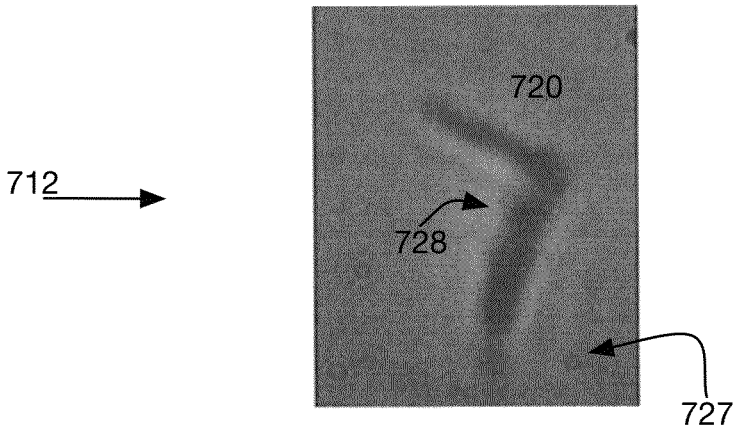
FIG. 7 is a shadowgraph of an exemplary shaped target.

Referring to FIG. 7, a shadowgraph of an exemplary shaped target 720 is shown. A shadowgraph is created by illuminating an object with light. Dense portions of the object reflect the light, casting a shadow on a camera (such as a charge coupled device (CCD)) that images the scene. The target 720 was formed using remaining plasma 727 that was generated from a prior laser-target material interaction. In the example shown, laser-target material interactions occurred with a frequency of 60 kHz (a repetition rate of 60 kHz). Thus, additional shaped targets similar to the target 720 were generated every 16.67 μs.

The target 720 is converted to plasma that emits EUV light by irradiating the target 720 with an amplified light beam (such as the amplified light beams 110, 210, or 510) that propagates in a direction 712. The target 720 includes a recess 728 in which plasma generated during an interaction between the amplified light beam and the target 720 is confined, thereby increasing the amount of EUV light produced from the interaction. The recess 728 is open to the oncoming amplified light beam.

Figure 8:
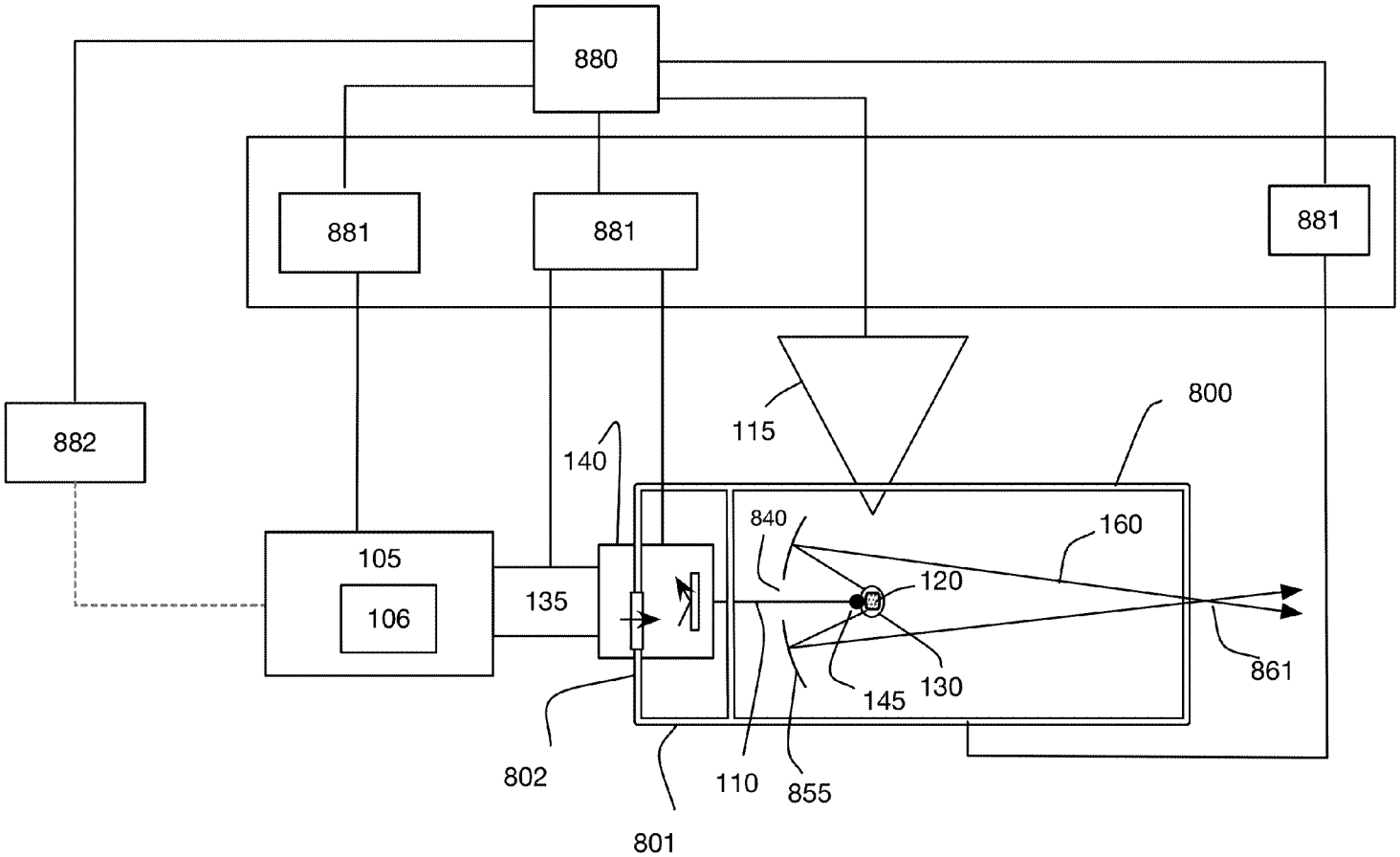
FIG. 8 is a block diagram of an exemplary laser produced plasma extreme ultraviolet light (EUV) source.

Referring to FIG. 8, in some implementations, the extreme ultraviolet light system 100 is a part of a system that includes other components, such as a vacuum chamber 800, one or more controllers 880, one or more actuation systems 881, and a guide laser 882.

The vacuum chamber 800 can be a single unitary structure or it can be set up with separate sub-chambers that house specific components. The vacuum chamber 800 is at least a partly rigid enclosure from which air and other gases are removed by a vacuum pump, resulting in a low-pressure environment within the chamber 800. The walls of the chamber 800 can be made of any suitable metals or alloys that are suitable for vacuum use (can withstand the lower pressures).

The target material delivery system 115 delivers the target material 120 to the target region 130. The target material 120 at the target region can be in the form of liquid droplets, a liquid stream, solid particles or clusters, solid particles contained within liquid droplets or solid particles contained within a liquid stream. The target material 120 can include, for example, water, tin, lithium, xenon, or any material that, when converted to a plasma state, has an emission line in the EUV range. For example, the element tin can be used as pure tin (Sn), as a tin compound, for example, $SnBr_4$, $SnBr_2$, $SnH_4$, as a tin alloy, for example, tin-gallium alloys, tin-indium alloys, tin-indium-gallium alloys, or any combination of these alloys. The target material 120 can include a wire coated with one of the above elements, such as tin. If the target material 120 is in a solid state, it can have any suitable shape, such as a ring, a sphere, or a cube. The target material 120 can be delivered by the target material delivery system 115 into the interior of the chamber 800 and to the target region 130. The target region 130 is also referred to as an irradiation site, the place where the target material 120 optically interacts with the amplified light beam 110 to produce the plasma. As discussed above, the remaining plasma is formed at or near the irradiation site. Thus, the remaining plasma and the shaped targets 221*b*, 221*c*, and 521 can be generated in the vacuum chamber 800. In this manner, the shaped targets 221*b*, 221*c*, and 521 are generated in the EUV light system 100.

The drive laser system 105 can include one or more optical amplifiers, lasers, and/or lamps for providing one or more main pulses and, in some cases, one or more pre-pulses. Each optical amplifier includes a gain medium capable of optically amplifying the desired wavelength at a high gain, an excitation source, and internal optics. The optical amplifier may or may not have laser mirrors or other feedback devices that form a laser cavity. Thus, the drive laser system 105 produces the amplified light beam 110 due to the population inversion in the gain media of the laser amplifiers even if there is no laser cavity. Moreover, the drive laser system 105 can produce an amplified light beam 110 that is a coherent laser beam if there is a laser cavity to provide enough feedback to the drive laser system 105. The term "amplified light beam" encompasses one or more of: light from the drive laser system 105 that is merely amplified but not necessarily a coherent laser oscillation and light from the drive laser system 105 that is amplified and is also a coherent laser oscillation.

The optical amplifiers in the drive laser system 105 can include as a gain medium a filling gas that includes $CO_2$ and can amplify light at a wavelength of between about 9100 and about 11000 nm, and in particular, at about 10600 nm, at a gain greater than or equal to 1000. Suitable amplifiers and lasers for use in the drive laser system 105 can include a pulsed laser device, for example, a pulsed, gas-discharge $CO_2$ laser device producing radiation at about 9300 nm or about 10600 nm, for example, with DC or RF excitation, operating at relatively high power, for example, 10 kW or higher and high pulse repetition rate, for example, 50 kHz or more. The optical amplifiers in the drive laser system 105 can also include a cooling system such as water that can be used when operating the drive laser system 105 at higher powers.

The light collector 155 can be a collector mirror 855 having an aperture 840 to allow the amplified light beam 110 to pass through and reach the focal region 145. The collector mirror 855 can be, for example, an ellipsoidal mirror that has a first focus at the target region 130 or the focal region 145, and a second focus at an intermediate location 861 (also called an intermediate focus) where the EUV light 160 can be output from the extreme ultraviolet light system and can be input to the optical apparatus 165.

The one or more controllers 880 are connected to the one or more actuation systems or diagnostic systems, such as, for example, a droplet position detection feedback system, a laser control system, and a beam control system, and one or more target or droplet imagers. The target imagers provide an output indicative of the position of a droplet, for example, relative to the target region 130 and provide this output to the droplet position detection feedback system, which can, for example, compute a droplet position and trajectory from which a droplet position error can be computed either on a droplet by droplet basis or on average. The droplet position detection feedback system thus provides the droplet position error as an input to the controller 880. The controller 880 can therefore provide a laser position, direction, and timing correction signal, for example, to the laser control system that can be used, for example, to control the laser timing circuit and/or to the beam control system to control an amplified light beam position and shaping of the beam transport system to change the location and/or focal power of the beam focal spot within the chamber 800.

The target material delivery system 115 includes a target material delivery control system that is operable in response to a signal from the controller 880, for example, to modify the release point of the droplets as released by an internal delivery mechanism to correct for errors in the droplets arriving at the desired target region 130.

Additionally, extreme ultraviolet light system can include a light source detector that measures one or more EUV light parameters, including but not limited to, pulse energy, energy distribution as a function of wavelength, energy within a particular band of wavelengths, energy outside of a particular band of wavelengths, and angular distribution of EUV intensity and/or average power. The light source detector generates a feedback signal for use by the controller 880. The feedback signal can be, for example, indicative of the errors in parameters such as the timing and focus of the laser pulses to properly intercept the droplets in the right place and time for effective and efficient EUV light production.

In some implementations, the drive laser system 105 has a master oscillator/power amplifier (MOPA) configuration with multiple stages of amplification and having a seed pulse that is initiated by a Q-switched master oscillator (MO) with low energy and high repetition rate, for example, capable of 100 kHz operation. From the MO, the laser pulse can be amplified, for example, using RF pumped, fast axial flow, $CO_2$ amplifiers to produce the amplified light beam 110 traveling along a beam path.

Although three optical amplifiers can be used, it is possible that as few as one amplifier and more than three amplifiers could be used in this implementation. In some implementations, each of the $CO_2$ amplifiers can be an RF pumped axial flow $CO_2$ laser cube having a 10 meter amplifier length that is folded by internal mirrors.

Alternatively, the drive laser system 105 can be configured as a so-called "self-targeting" laser system in which the target material 120 serves as one mirror of the optical cavity. In some "self-targeting" arrangements, a master oscillator may not be required. The drive laser system 105 includes a chain of amplifier chambers, arranged in series along a beam path, each chamber having its own gain medium and excitation source, for example, pumping electrodes. Each amplifier chamber can be an RF pumped, fast axial flow, $CO_2$ amplifier chamber having a combined one pass gain of, for example, 1,000-10,000 for amplifying light of a wavelength $\lambda$ of, for example, 10600 nm. Each of the amplifier chambers can be designed without laser cavity (resonator) mirrors so that when set up alone they do not include the optical components needed to pass the amplified light beam through the gain medium more than once. Nevertheless, as mentioned above, a laser cavity can be formed as follows.

In this implementation, a laser cavity can be formed by adding a rear partially reflecting optic to the drive laser system 105 and placing the target material 120 at the target region 130. The optic can be, for example, a flat mirror, a curved mirror, a phase-conjugate mirror, a grating, or a corner reflector having a reflectivity of about 95% for wavelengths of about 10600 nm (the wavelength of the amplified light beam 110 if $CO_2$ amplifier chambers are used). The target material 120 and the rear partially reflecting optic act to reflect some of the amplified light beam 110 back into the drive laser system 105 to form the laser cavity. Thus, the presence of the target material 120 at the target region 130 provides enough feedback to cause the drive laser system 105 to produce coherent laser oscillation and in this case, the amplified light beam 110 can be considered a laser beam. When the target material 120 isn't present at the target region 130, the drive laser system 105 may still be pumped to produce the amplified light beam 110 but it would not produce a coherent laser oscillation unless some other component provides enough feedback. This arrangement can be a so-called "self-targeting" laser system in which the target material 120 serves as one mirror (a so-called plasma mirror or mechanical q-switch) of the optical cavity.

Depending on the application, other types of amplifiers or lasers can also be suitable, for example, an excimer or molecular fluorine laser operating at high power and high pulse repetition rate. Examples include a solid state laser, for example, having a fiber or disk shaped gain medium, a MOPA configured excimer laser system, as shown, for example, in U.S. Pat. Nos. 6,625,191; 6,549,551; and 6,567,450; an excimer laser having one or more chambers, for example, an oscillator chamber and one or more amplifying chambers (with the amplifying chambers in parallel or in series); a master oscillator/power oscillator (MOPO) arrangement, a power oscillator/power amplifier (POPA) arrangement; or a solid state laser that seeds one or more excimer or molecular fluorine amplifier or oscillator chambers, may be suitable. Other designs are possible.

At the irradiation site, the amplified light beam 110, suitably focused by the focus assembly 142, is used to create plasma having certain characteristics that depend on the composition of the target material 120. These characteristics can include the wavelength of EUV light 160 produced by the plasma and the type and amount of debris released from the plasma. The amplified light beam 110 evaporates the target material 120, and heats the vaporized target material to a critical temperature at which electrons are shed (a plasma state), leaving behind ions, which are further heated until they start emitting photons having a wavelength in the extreme ultraviolet range.

Other implementations are within the scope of the following claims.

For example, although the region 226*a* and the remaining plasma 227*a* are shown as being within the target region 230, this is not necessarily the case. In other examples, the region 226*a* and/or the remaining plasma 227*a* can extend beyond the target region 230. Additionally, the remaining plasma 227*a* and/or the region 226*a* can have any spatial form.

In the example of FIGS. 2C and 2D, the regions 226*a* and 226*b* and the corresponding remaining plasma 227*a* and 227*b* are in the target region 230 at different times, with no temporal overlap. However, in other implementations, the remaining plasma 227*a* and 227*b* can be in the target region 230 at the same time. For example, a remaining plasma generated from an interaction between a target material and a pulse of the amplified light beam 210 can persist and be present in the target region 230 through more than one cycle of the amplified light beam 210. In some implementations, a remaining plasma can be continuously present in the target region 230.

The example of FIGS. 2C and 2D shows continuous emission of EUV light, where EUV light is emitted at periodic intervals determined by the system repetition rate and the intervals between EUV light emission are such that the emission of EUV light is essentially continuous. However, the EUV light source can be operated in other modes depending on the needs of a lithography tool that receives the generated EUV light. For example, the EUV light source also can be operated or set to emit EUV light in bursts that are separated in time by an amount greater than the system repetition rate or at an irregular interval.

What is claimed is:

1. A method comprising:

forming a first remaining plasma that at least partially coincides with a target region, the first remaining plasma being formed from a previous extreme ultraviolet (EUV)-light producing interaction between target material and an amplified light beam;

providing a target comprising target material in a first spatial distribution to the target region, the target material comprising material that emits EUV light when converted to plasma;

allowing the first remaining plasma and the initial target to interact, the interaction rearranging the target material from the first spatial distribution to a shaped target distribution to form a shaped target in the target region, the shaped target comprising the target material arranged in the shaped target distribution, the shaped target distribution comprising sides that define a concave region;

directing the amplified light beam toward the concave region of the shaped target in the target region, an interaction between the amplified light beam and the target material of the shaped target converting at least some of the target material in the shaped target to a plasma that emits EUV light, and the sides of the concave region confining at least some of the plasma that emits EUV light; and allowing a second remaining plasma to form in the target region.

2. The method of claim 1, wherein the sides of the shaped target distribution extend from a vertex, and the concave region is a recess defined by the sides and the vertex.

3. The method of claim 1, wherein the amplified light beam is a pulsed amplified light beam.

4. The method of claim 1, wherein providing a target comprising target material in a first spatial distribution to the target region comprises providing a disk-shaped target to the target region.

5. The method of claim 4, wherein providing a disk-shape target comprises:

releasing a target material droplet comprising target material from a target material supply apparatus toward the target region;

directing a pulse of radiation toward the target material droplet to interact the pulse of radiation with the target material droplet while the target material droplet is between the target material supply apparatus and the target region, the first pulse of radiation having an energy sufficient to initiate a modification of a spatial distribution of the target material of the target material droplet; and allowing the target material droplet to expand in two dimensions after the interaction between the pulse of radiation and the target material droplet to form the disk-shaped target.

6. The method of claim 5, wherein the target material droplet expands in two dimensions by expanding in a plane that is perpendicular to a direction of propagation of the amplified light beam.

7. The method of claim 6, wherein the target material droplet narrows in a direction that is parallel to the direction of propagation to form the disk-shaped spatial distribution of target material.

8. The method of claim 6, wherein the first pulse of radiation comprises a pulse of laser light having a wavelength of 1.06 microns (μm) and the amplified light beam is a pulsed laser beam having a wavelength of 10.6 μm.

9. The method of claim 1, further comprising:

providing a second target comprising target material in the first spatial distribution to the target region;

allowing the second remaining plasma and the second target to interact, the interaction arranging the target material in the first spatial distribution to the shaped target distribution to form a second shaped target in the target region;

directing the amplified light beam toward the target region to convert at least some of the second shaped target to a plasma that emits EUV light; and allowing a third remaining plasma to form in the target region, the third remaining plasma being formed from converting at least some of the second shaped target to the plasma that emits EUV light.

10. The method of claim 8, wherein the amplified light beam is directed toward the target region and the second shaped target no more than 25 microseconds (μs) after the amplified light beam is directed toward the first shaped target.

11. The method of claim 10, wherein a first burst of EUV light is produced after directing the amplified light beam toward the target region and the shaped target, and a second burst of EUV light is produced after directing the amplified light beam toward the target region and the second shaped target, the first and second EUV bursts occurring no more than 25 μs apart.

12. The method of claim 6, wherein the first pulse of radiation and the amplified light beam have the same wavelength.

13. The method of claim 1, wherein the confined plasma heats the target material in the sides of the shaped target to produce EUV light.

14. A method comprising:

forming a remaining plasma that at least partially coincides with a target region, the remaining plasma being a plasma formed from a previous extreme ultraviolet (EUV)-light producing interaction between target material and an amplified light beam, the interaction between the target material and the amplified light beam occurring in the target region;

providing a target comprising target material in a first spatial distribution to an initial target region, the target material comprising material that emits EUV light when converted to plasma, the initial target region being spatially distinct from the target region;

initiating a modification of the first spatial distribution of target material in two dimensions by interacting the target with a first pulse of radiation in the initial target region;

allowing the first spatial distribution of target material to change in the two dimensions after interacting the target with the first pulse of radiation to form a modified target;

shaping the modified target in three dimensions by allowing the modified target to enter into the target region and interact with the remaining plasma in the target region to form a shaped target; and directing an amplified light beam toward the target region and the shaped target to form a plasma that emits EUV light.

15. The method of claim 14, wherein the two dimensions comprise two dimensions that extend in a plane that is perpendicular to the direction of propagation of the amplified light beam.

16. The method of claim 14, wherein initiating a modification of the first spatial distribution in two dimensions comprises directing a pulsed laser beam toward the target such that a pulse of the laser beam interacts with the target.

17. The method of claim 16, wherein the two dimensions comprise two dimensions that extend in a plane that is perpendicular to the direction of propagation of the pulsed laser beam.

18. The method of claim 17, wherein the modified target has a larger cross-sectional area in the plane that is perpendicular to the direction of propagation of the pulsed laser beam than the target.

19. The method of claim 15, wherein the shaped target distribution comprises a concave region that is open to the amplified light beam.

20. The method of claim 14, wherein the target region is in an interior of a vacuum chamber of an EUV light source.

21. The method of claim 14, wherein directing the amplified light beam toward the target region comprises directing the amplified light beam in a direction of propagation, and focusing the amplified light beam to a focus, the focus being in a plane that is perpendicular to the direction of propagation.

22. The method of claim 14, wherein the shaped target distribution comprises sides that extend from a vertex, the sides forming an open region, and the open region being oriented toward the amplified light beam.

23. The method of claim 21, wherein the focus is in a plane that is different from a parallel plane that includes the shaped target in the target region.

* * * * *